United States Patent [19]

Kurth et al.

[11] Patent Number: 4,504,497

[45] Date of Patent: Mar. 12, 1985

[54] CARTON FOR PACKAGING A SEMI-SOLID BULK FORM

[75] Inventors: Charles W. Kurth; John M. Moerchen, both of Ozaukee County, Wis.

[73] Assignee: Alton Packaging Corporation, Alton, Ill.

[21] Appl. No.: 523,010

[22] Filed: Aug. 15, 1983

[51] Int. Cl.[3] ..... B65D 5/68; B65D 85/72; B65D 85/76; B65D 5/00

[52] U.S. Cl. ..... 426/130; 220/441; 229/23 R; 229/DIG. 4; 426/124

[58] Field of Search ..... 229/23 R, 17 SC, 15, 229/23 BY, DIG. 2, DIG. 4; 220/441, 443; 426/124, 130

[56] References Cited

U.S. PATENT DOCUMENTS

| | | | |
|---|---|---|---|
| 1,550,646 | 8/1925 | Larson | 229/DIG. 2 |
| 1,973,930 | 9/1934 | Rammer | 229/DIG. 4 |
| 2,453,829 | 11/1948 | Blackman | 229/23 R |
| 2,710,134 | 6/1955 | Schroeder et al. | 229/DIG. 2 |
| 2,749,013 | 6/1956 | Wilkinson | 220/441 |
| 2,798,596 | 7/1957 | Emmons | 229/DIG. 2 |
| 2,949,151 | 8/1960 | Goldstein | 229/DIG. 2 |
| 2,985,075 | 5/1961 | Knutsson-Hall | 229/DIG. 4 |
| 3,007,622 | 11/1961 | George | 229/23 R |
| 3,100,712 | 8/1963 | Meeker et al. | 426/130 |
| 3,503,550 | 3/1970 | Main et al. | 220/71 |
| 3,715,072 | 2/1973 | Muskopf et al. | 229/15 |
| 3,744,701 | 7/1973 | Taylor | 229/15 |
| 3,744,702 | 7/1973 | Ellison | 229/23 R |
| 3,904,105 | 9/1975 | Booth | 229/17 SC |
| 3,913,822 | 10/1975 | Heaps | 229/DIG. 4 |
| 4,087,041 | 5/1978 | Centanni | 220/441 |
| 4,129,246 | 12/1978 | Rustin et al. | 229/23 R |
| 4,174,803 | 11/1979 | Shrontz et al. | 229/23 R |
| 4,177,935 | 12/1979 | Centanni | 229/23 R |
| 4,177,936 | 12/1979 | Ford et al. | 220/441 |
| 4,260,071 | 4/1981 | Bamburg et al. | 220/443 |
| 4,296,860 | 10/1981 | Hsu et al. | 229/23 R |
| 4,328,924 | 5/1982 | Neff et al. | 206/606 |

FOREIGN PATENT DOCUMENTS

| | | | |
|---|---|---|---|
| 247102 | 6/1963 | Australia | 426/130 |
| 977069 | 12/1964 | United Kingdom | 229/DIG. 4 |
| 2041331 | 9/1980 | United Kingdom | 426/130 |

*Primary Examiner*—Steven Weinstein
*Attorney, Agent, or Firm*—Paul M. Denk

[57] ABSTRACT

A carton for packaging a bulk semi-solid material, such as a block of unhardened cheese, or the like, is disclosed. The carton comprises a one-piece wrapper of multi-layered corrugated box board material with the wrapper having slit-score lines formed therein permitting the wrapper to be folded on itself so as to form flutes or corners having a relatively sharp radius of curvature with these corners being in register with the side corners of the block and with the faces of the wrapper being in firm face-to-face abutting engagement with the side faces of the block. The carton further includes an open-ended sleeve or tube having generally the same cross sectional shape as the block with the wrapper wrapped therearound, this sleeve being telescopically received by the wrapper on the polyhedron with the sleeve securely holding the wrapper in place on the block of the semi-solid material. A first overfitting tray lid is applied to the upper end of the sleeve such that the panel or tray face of the tray lid bears firmly on the upper end face of the block. Then, another tray lid is then applied to the opposite end face of the block.

1 Claim, 9 Drawing Figures

CARTON FOR PACKAGING A SEMI-SOLID BULK FORM

BACKGROUND OF THE INVENTION

This invention relates to a method of and to a carton for packaging a semi-solid bulk material, such as a block of unhardened cheese or the like.

In the manufacture of cheese, it is conventional to package a bulk amount of the newly-processed cheese (e.g., 640 pounds or 290 kg.) in a bulk package. Then, at a later date, the bulk cheese may be removed from the bulk package, formed into retail-size blocks (e.g., one pound or 0.45 kg.) which are individually packaged for retail sale or for distribution.

Generally, when the unhardened cheese is removed from its processing equipment, the cheese is in semi-solid state (i.e., while it is generally a solid, it will, under its own weight, have a tendency to flow), and a bulk quantity of the cheese (e.g., 640 pounds) is placed on a conveyor. The cheese was conventionally wrapped and put into a conventional, heavy-duty cardboard carton. However, due to the tendency of the not-yet hardened (i.e., semi-solid) cheese to flow, and due to the quasi-hydrostatic forces exerted on the side walls of the carton containing the cheese, the cheese has a tendency to cause the side walls of the carton to bulge outwardly and to further cause the corners of the carton to bulge, thus resulting in rounded corners for the cheese. To aid in future processing of the bulk form of cheese, it is desirable that the hardened bulk cheese block be maintained in a desired shape (i.e., preferably a polyhedron shape, such as a cube) having generally flat or planar sides and having substantially square (as opposed to rounded) corners. Reference may be made to U.S. Pat. No. 4,328,924 which discloses an article container comprising a sleeve and having a pair of overfitting closure caps. However, the article container of the above-mentioned prior patent is of a substantially different construction and is intended for substantially different use than the method and carton of the present invention.

SUMMARY OF THE INVENTION

This invention relates to a method of and to a carton for packaging a bulk quantity of a semi-solid material in a block form (preferably a polyhedron form) wherein the semi-solid material is positively maintained in its desired polyhedron shape during hardening so that when the block is removed from the carton, it will have substantially planar (e.g., flat) sides and will further have relatively square corners;

The provision of such a packaging method and carton which is relatively easy to apply to a bulk semi-solid block and which accomodates a variety of dimensional changes of the semi-solid block form prior to being encased within the carton of the present invention;

The provision of such a carton which is of a construction such that it will adequately maintain the semi-solid block and its desired polyhedron (or other) shape even when the filled carton is stored for extended periods of time in high moisture environments;

The provision of such a carton which is reusable; and

The provision of such a carton which is of relatively inexpensive construction, which is easy to fabricate, which can be shipped from the carton manufacturing facility to the end-user in a knocked-down condition, and which may be readily erected and applied to the semi-solid block by the end-user.

Other objects and features of this invention will be in part apparent and in part pointed out hereinafter.

Briefly stated, the packaging method of the present invention is to be utilized for packaging a bulk semi-solid material, such as a block of bulk cheese or the like, having a pair of spaced, parallel end faces and having one or more side faces. Specifically, the method of this invention comprises wrapping a wrapper (or a liner) around the side face(s) of the block, this wrapper being of substantially rigid wall construction and having a face for each of the side face(s) of the block of the semi-solid material. Then, a sleeve or tube is telescopically slid down over the wrapper, the sleeve being open-ended and having a side face for each of the faces of the wrapper and of the block with the wrapper having a height substantially equal to the height of the wrapper. A first overfitting tray lid is placed on the upper end of the sleeve with the tray lid being of substantially rigid wall construction and having a planar tray lid face engagable with one end of the face (i.e., the upper face) of the block of the semi-solid material. The tray lid further has sides which fit down over the upper outer margins of the sleeve. Then, a second overfitting tray lid is applied to the other end of the sleeve with the tray face of the second tray lid being in engagement with the other lid face of the block of the semi-solid material, whereby the semi-solid material is maintained in its desired shape.

Still further, the carton of this invention for packaging a bulk quantity of semi-solid material will now be defined. The semi-solid material is desirably in the form of a block having at least one side face, and further having a pair of generally parallel end faces. The carton of this invention positively maintains the semi-solid material in its desired block form. The carton comprises a one-piece wrapper of rigid wall corrugated box board construction adapted to be applied to the side face(s) of the block of the semi-solid material. Then, an open-ended sleeve or tube having a side face for each of the side faces of the wrapper and of the block is telescopically received on the outside of the wrapper with the side faces of the sleeve being in face-to-face sliding engagement with the side faces of the wrapper thereby to securely hold the side faces of the wrapper in engagement with the side faces of the block and with both the sleeve and the wrapper cooperatively holding the semi-solid material in its desired block form. An overfitting tray lid is applied to each end of the sleeve with each of these tray lids having a planar tray lid face in engagement with a respective end face of the block of the semi-solid material.

BRIEF DESCRIPTION OF THE DRAWINGS

In the drawings, FIG. 1 is a perspective view of a carton of the present invention illustrating a pair of overfitting tray lids applied to a tube sleeve fitted over a wrap-around liner with the carton containing a bulk quantity of semi-solid material (e.g., unhardened cheese) in a desired polyhedron block and further with the tray lids being firmly secured on the end faces of the block by means of strapping or the like;

Corresponding reference characters represent the corresponding parts throughout the several views of the drawings.

DESCRIPTION OF THE PREFERRED EMBODIMENT

Figure 1:
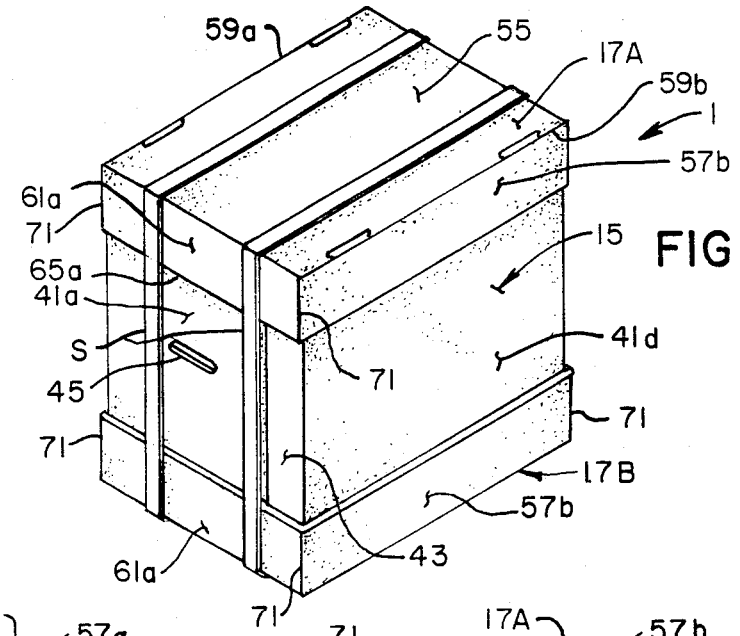
Figure 2:
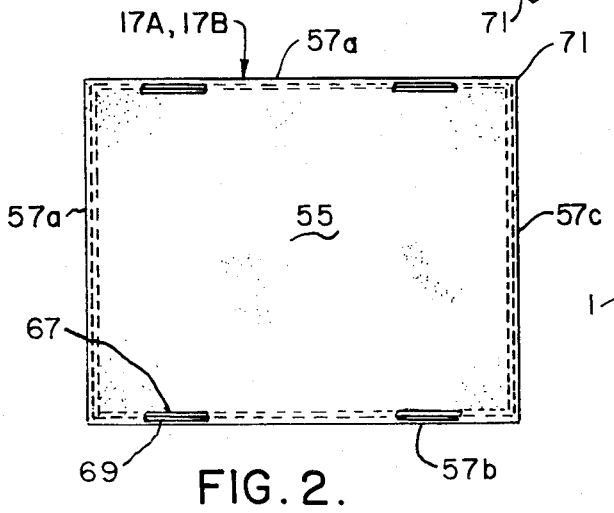
FIG. 2 is a top plan view of the carton shown in FIG. 1.
Figure 3:
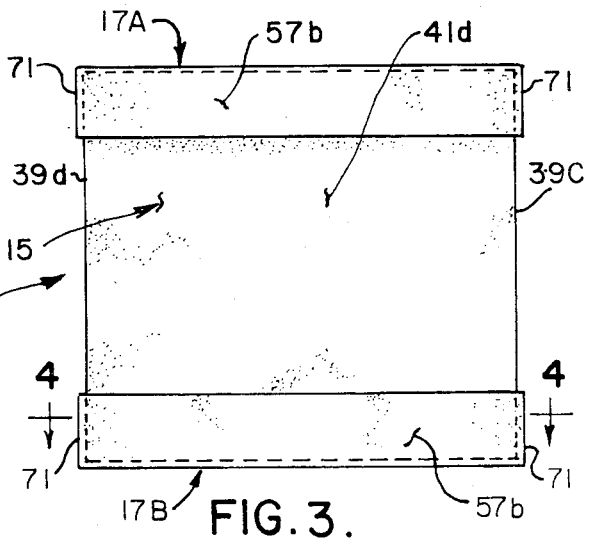
FIG. 3 is a right side elevational view of the carton, as it is viewed in FIG. 1.
Figure 4:
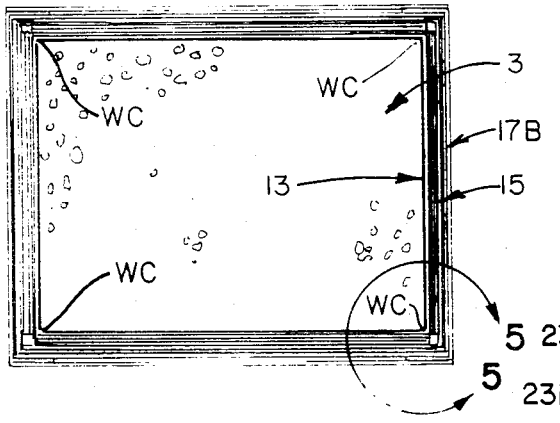
FIG. 4 is a horizontal cross sectional view of the carton taken along line 4—4 of FIG. 3.
Figure 5:
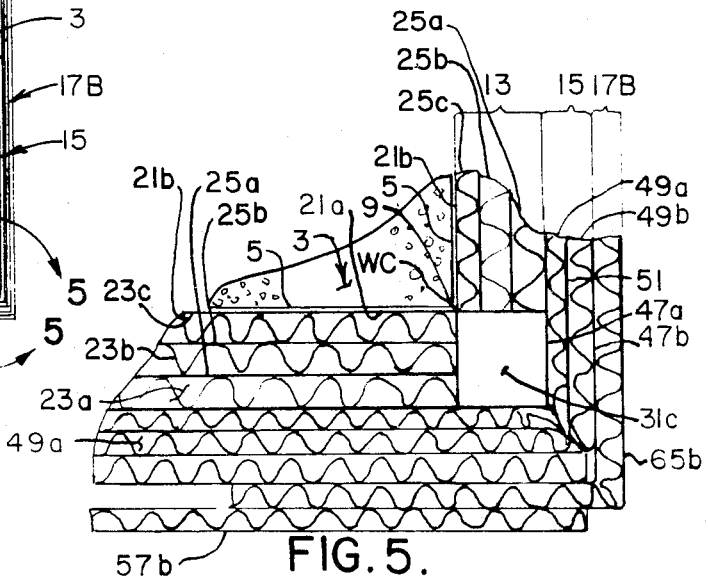
FIG. 5 is a view taken along line 5—5 of FIG. 4 illustrating, on an enlarged scale, the details of construction of the wrap-around sleeve wrapper, of the overfitting tube sleeve, and of the tray lid, at a typical corner of the carton.
Figure 6:
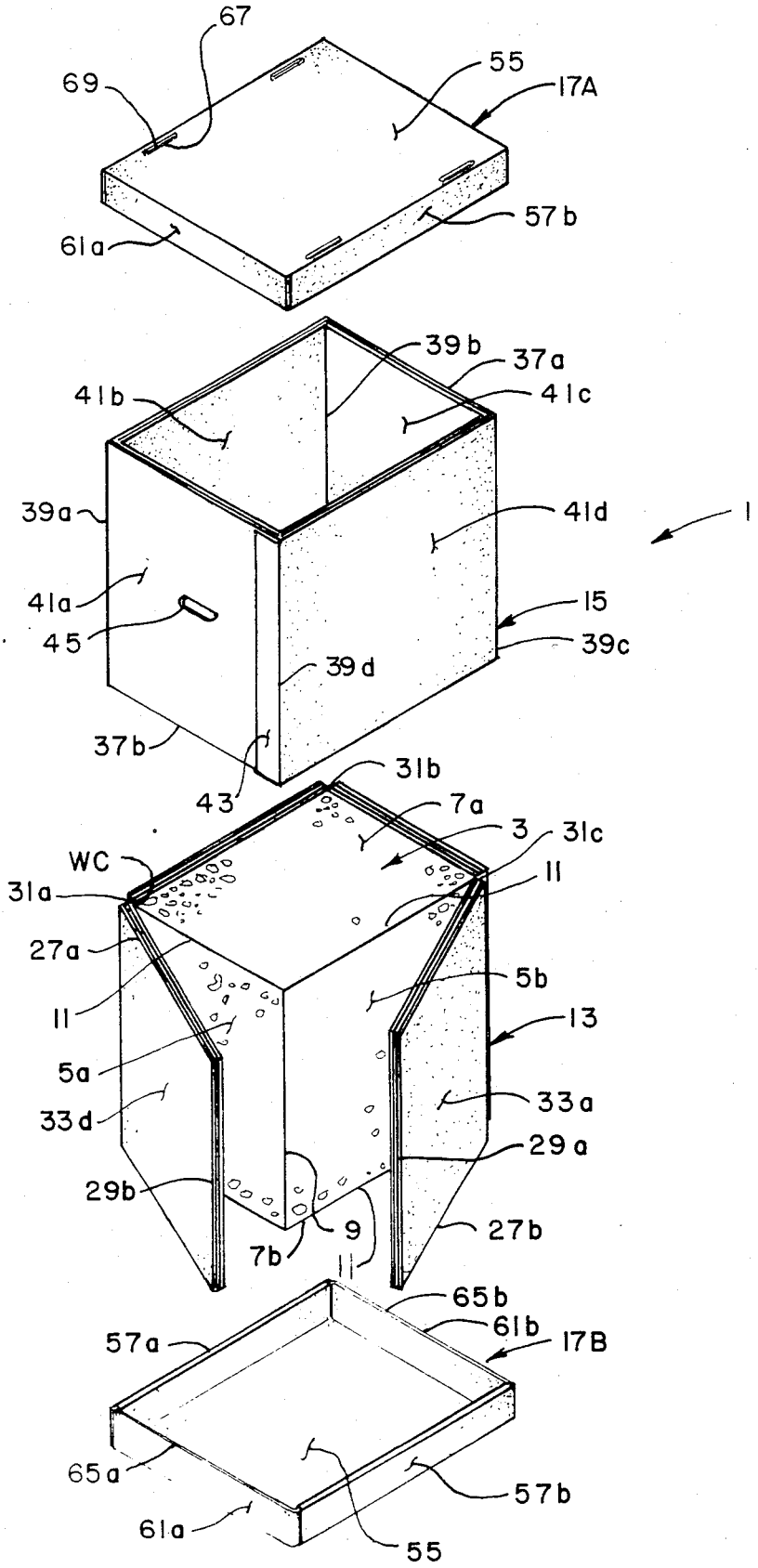
FIG. 6 is an exploded perspective view of the carton of this invention enclosing the block of semi-solid material and further illustrating the method of this invention in which the block of semi-solid material is first wrapped by a wrapper, in which a telescopic tube sleeve is telescopically inserted down over the side of the wrapper, and in which overfitting tray lids are applied to the top and bottom of the tube sleeve so as to be in engagement with the end faces of the block.

Referring now to the drawings, FIGS. 1-5 and 7-9 depict a carton, as generally indicated at 1, constructed in accordance with this invention, and FIG. 6, depicts a carton 1 and the various steps of the method of this invention of packaging a block as generally indicated at 3, of a semi-solid material, (e.g., such as unhardened cheese or the like), having at least one side face 5.

More specifically, block 3 of the semi-solid material may be a relatively large block of unhardened cheese weighing, for example, about 640 pounds (290 kg.). Block 3 is shown to be a hexahedron shape having a pair of minor rectangular side faces, as indicated at 5*a*, 5*c*, and another pair of opposed major rectangular side faces, as indicated at 5*b*, 5*d*. Further, the hexahedron block 3 has a pair of opposed rectangular end faces 7*a*, 7*c*, constituting the top and bottom of the block. The block further has side face corners 9 between adjacent side faces 7*a*–7*d*, and side face-to-end face corners 11. It will be understood that the semi-solid material (e.g., unhardened cheese) will, immediately after removal from its mold (not shown) generally retain its desired block shape, but the semi-solid material (e.g., unhardened cheese) will flow under its own weight and will not, for a matter for more than a short period of time, retain its block shape. Carton 1 of the present invention is intended to be placed around block 3 so as to positively hold the block of semi-solid material in its desired hexahedral (or other desired) shape in such a manner as to positively maintain its side faces and end faces in a flat, planar condition and also to maintain well-defined, square corners 9 and side face-to-end face corners 11. It will be understood that by insuring flat side faces and sharp corners for block 3, the bulk block of hardened cheese, after being removed from the carton 1 of the present invention, may be more readily handled during further processing of the block.

Referring now to FIG. 6, the major portions of carton 1 are shown to comprise a one-piece wrapper or liner 13 adapted to be broken or folded in a manner as will appear and adapted to have planar wrapper panels engagable with respective side faces 5*a*–5*d* of block 3 with the hingedly connected panels of the wrapper being hingedly folded on a relatively small radius so as to define sharp or square side corners 9 for block 3 in a manner as will hereinafter appear in detail.

Carton 1 further includes an open-ended sleeve or tube, as indicated generally by character reference 15, which has a polygonal cross section generally similar to the cross section of wrapper 13 as it is tightly wrapped around the side faces 5*a*–5*d* of block 3 with the sleeve being telescopically received on the outside of wrapper 13. Further, carton 1 includes a pair of overfitting tray lids, as indicated generally at 17A, 17B, applied to the top and bottom margins of sleeve 15 and with the inner faces of the tray lids bearing against the end faces 7*a*, 7*b* of block 3. As indicated at S in FIG. 1, conventional metal or nylon strapping may be tightly banded around carton 1 so as to securely fasten tray lids 17A, 17B in a compressed condition on block end faces 7*a*, 7*b* thereby holding all the parts of the carton together and permitting the relatively heavy, loaded carton 1 of this invention to be readily transported or conveyed.

Figure 7:
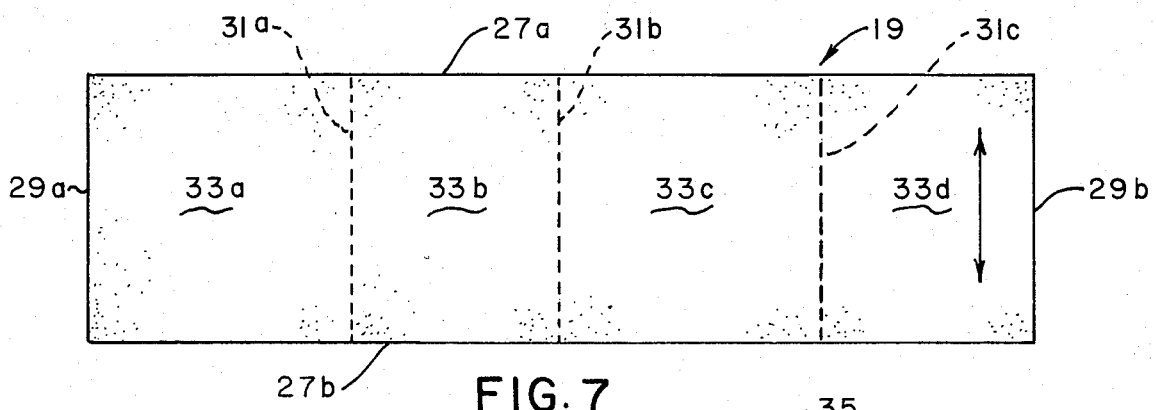
FIG. 7 is a flat pattern layout of a sheet of box board material slit-scored so as to form the wrapper liner or liner.

Referring to FIG. 7, wrapper 13 is shown to be constituted by a flat blank 19 of rigid box board corrugated material having multi-layered face sheets 21*a*, 21*b* of kraft paper or the like (as best shown in FIG. 5), with three corrugation cores, as indicated at 23*a*–23*c*, interposed between the face sheets and further having intermediate sheets 25*a*, 25*b* interposed between corrugation cores 23*a* and 23*b* and between corrugation cores 23*b* and 23*c*. As is conventional, the various corrugation cores 23*a*–23*c* are adhesively bonded to face sheets 21*a*, 21*b* and to intermediate sheets 25*a*, 25*b*. For example, such box board construction may be of 1,000 pound test designated as A/A/C box board material, having a weight of approximately 10,310 pounds per 1,000 square feet of the box board material. However, it is to be understood that the above designation of box board material for blank 19 is merely for purposes of illustration, and those skilled in the art will recognize that a wide variety of other weights and constructions of box board or other rigid wall materials may be utilized in accordance with the broader aspects of the invention.

Still referring to FIG. 7, wrapper blank 19 is shown to have a top edge 27*a* and an opposed bottom edge 27*b* and further having one side edge 29*a* and an opposite side edge 29*b* such that the blank 19 is of generally rectangular form. Still further, blank 19 is provided with three slit-score lines of weakness, as indicated at 31*a*–31*c*, extending perpendicularly between the top and bottom side edges 27*a*, 27*b* with these slit-score lines defining a plurality of major wrapper side panels, 33*a*, 33*c* and minor wrapper side panels 33*b*, 33*d*. These slit-score lines 31*a*—31*c* constitute hinged fold lines on which the wrapper blank 19 may be bent inwardly on itself so as to form the corners of the wrapper 13 with the location of the wrapper corners WC corresponding generally to the location of side corners 9 of block 3 to be enclosed therewithin. Further, because the slit-score lines 31*a*–31*c* are constituted by a slit or a cut made through at least one face sheet 21*a* and through one or more layers of corrugation cores 23*a* and 23*b*, when the wrapper panels 33*a*–33*d* are folded on themselves along the hinged slit-score lines 31*a*–31*c*, as generally shown in FIG. 6, a relatively sharp inside wrapper corner, as indicated at WC in FIGS. 4 and 5, is formed on the inside faces of wrapper 13 in generally close proximity to the desired locations of block side corners 9.

More specifically, in accordance with this invention, wrapper corners WC have as small a radius of curvature as is possible, but preferably having a radius of curvature less than about one-quarter inch (6 mm.), and even more preferably less than about one-eighth inch (3 mm.). It will be expressly understood that score-slits 31*a*–31*c* may be severed through all of the corrugation cores 23*a*–23*c* so that only the multi-layered inner face sheet 21*b* hingedly connects the adjacent side panels 33*a*–33*d* of the wrapper together, thus enabling the wrapper corners WC to be substantially perpendicular to one another with essentially sharp, square corners having little or no radius or fillets between the adjoining wrapper panels.

Figure 8:
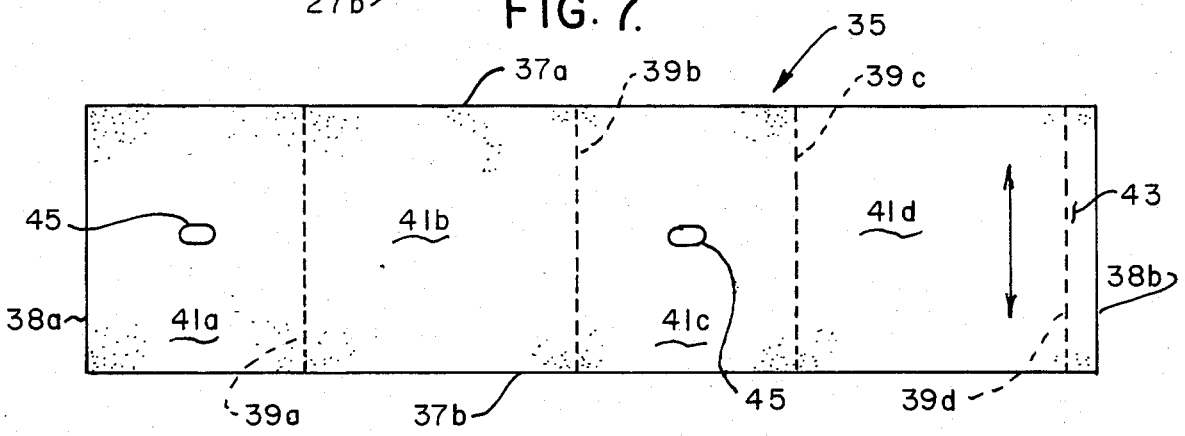
FIG. 8 is a flat pattern layout of a blank of corrugated box board material pre-slit and pre-formed so as to form the tube sleeve.

Referring now to FIG. 8, a sleeve blank, as indicated generally at 35, of suitable corrugated box board construction, is illustrated for forming sleeve 15. Like wrapper blank 19, sleeve blank 35 is of generally rectangular shape in flat pattern having an upper edge 37*a*, a lower edge 37*b*, and opposed side edges 38*a*, 38*b*. Four prescored fold lines, as indicated at 39*a*–39*d*, extend transversly between the upper and lower edges 37*a*, 37*b* of blank 35 with these fold lines defining major sleeve side panels 41*b*, 41*d*, and minor sleeve side panels 41*a*, 41*c*. Still further, score line 39*d* and side edge 38*b* defines a so-called securement flap 43.

As best illustrated in FIG. 6, sleeve blank 35 is adapted to be folded on itself along fold lines 39*a*–39*d* so as to form a generally rectangular tube having open ends and so that the securement flap 43 overlies the outer face of the margin of the sleeve blank adjacent edge 38*a* so that a suitble adhesive may be applied between the inner face of the securement flap and the outer face of the minor side panel 41*a* beneath the securement flap so as to securely join the ends of the sleeve blank together and so as to positively hold the sleeve in its desired assembled form. Further, optional handholds 45 may be provided in sleeve side panels 41*a*, 41*c* to aid in installation and removal of the sleeve on liner 13.

Figure 9:
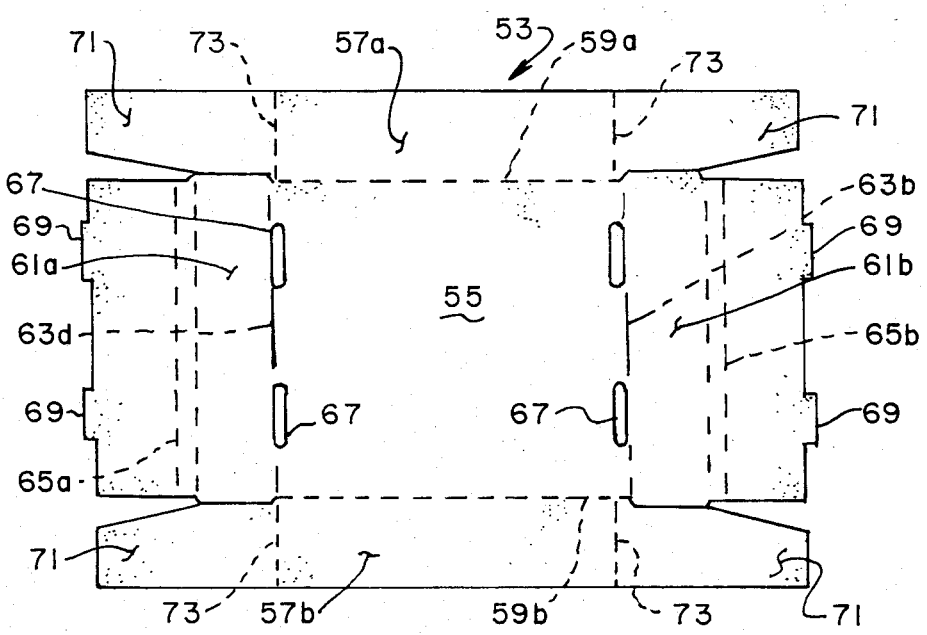
FIG. 9 is a flat pattern layout of a box board blank pre-slit and pre-scored so as to form one of the overfitting tray lids for the carton of the present invention.

As heretofore explained, carton 1 further includes a pair of identical overfitting tray lids, as previously indicated at 17A, 17B. Each of these tray lids is formed from a flat blank 53, as shown in FIG. 9, of suitable corrugated box board material. Blank 53 is formed from a single thickness of 275 pounds test corrugated box board having a weight of approximately 2,379 pounds per thousand square feet of material, which is die-cut to the shape, as generally illustrated in FIG. 9. More particularly, the tray lid blank 53 has a central lid panel 55 at the center thereof and further has pair of opposed major flaps 57*a*, 57*b* at opposite major sides of the central panel with a respective prescored fold line 59*a*, 59*b* between the central panel and the major flaps. Lidewise, at the opposite minor sides of the central lid panel, a pair of minor flaps, as indicated at 61*a*, 61*b*, is provided with corresponding minor flap fold lines 63*a*, 63*b* being provided between the minor flaps and the central tray panel. Each of the minor flaps 61*a*, 61*b* has, intermediate its free end and its corresponding fold line 63*a* or 63*b*, a pair of spaced-apart prescored fold lines 65*a*, 65*b* which permit the outer end portion of the minor flaps to be folded in double on itself. Further, a pair of slots, as indicated at 67, are die cut in central panel 55 along each of the minor flap fold lines 63*a*, 63*b* and these slots receive tabs 69 provided on the free ends of the minor flaps, thereby the securely lock the free ends of the outer flaps relative to top panel 55 when the minor flaps are bent double on themselves along fold lines 65*a*, 65*b* so as to add substantially to the rigidity of the tray lid.

Still further, each end of the major flaps 57*a*, 57*b* is provided with an elongate tap 71 which is adapted to be folded along a fold line 73 and which is adapted to be received by the inner and outer portions of the double folded minor flaps so that the major and minor flaps arre securely locked together by the tabs 71 of the major flaps interleaved with the double folded minor flaps. It will be further appreciated that the tray lid made in the manor above-described requires no fasteners or adhesives for securement or assembly, but yet provides a rigid overfitting-type tray lid which has interlocked major and minor side flaps capable of resisting considerable outward forces exerted thereon such as may be caused by the tendency of the semi-solid block 3 tending to flow under the force of gravity or quasi-hydrostatic forces exerted on carton 1 by the flowable, semi-solid block 3.

Referring now to FIG. 6, the packaging method of the present invention will be described. As is conventional, a block 3 of semi-solid cheese or the like is deposited on a conveyor (now shown). The block 3 is preformed so as to be generally in its desired hexahedronal shape, generally as illustrated in FIG. 6. First, wrapper or liner blank 19 is folded inwardly along the slit-score fold lines 31*a*—31*c* so as to form liner 13 which is open along its sides 29*a*, 29*b* with the major and minor faces 33*a*–33*d* of the liner disposed in fce-to-face engagement with respective major and minor sides 5*a*–5*d* of block 3. Further, it will be appreciated that the wrapper corners WC formed by slit-score line 31*a*–31*c* bear against respective corners 9 of block 3, and that the free ends 29*a*, 29*b* of blank 19 constitute a generally square corner disposed in close proximity to a corresponding block corner 9.

Then, with the wrapper tightly fitted around the sides of the block 3, a preassembled sleeve 15 is telescopically inserted onto the outside surfaces of line side panels 33*a*–33*d* from above so that the sleeve positively holds the side panels of the wrapper in tight face-to-face engagement with the corresponding side faces 5*a*–5*d* of the block thereby to prevent gravity or quasi-hydrostatic forces exerted on the wrapper by the semi-solid block 3 from causing the side faces of the block to bulge outwardly and so as to positively hold the wrapper corners WC against expending thus ensuring that block corners 9 are maintained in a substantially square, non-rounded condition with the radius of the cheese block corners being as small and as sharp as is practical.

With the wrapper 13 and the sleeve 15 in place around the sides of cheese block 3 as above-described, a first overfitting tray lid 17A is installed downwardly on the upper end of the sleeve 15 such that the inner face of tray lid panel 55 bears against the upper face 7*a* of block 3. Then, the entire partially assembled carton 1 together with the block therein is inverted so that the weight of block 3 bears fully on the central tray lid panel 55 of the first installed tray lid 17A and so that the bottom end face 7*b* of the block 3 (as viewed in FIG. 6), now constitutes the top end face of the block.

Then, a second overfitting tray lid 17B is applied to the now upwardly facing end face 7*b* of block 3, with the major and minor flaps of the second tray lid assembly fitting down over the outer, upper margins of sleeve 15. Those skilled in the art will appreciate that, within the broader aspects of this invention, it is not necessary to invert the block to apply the second lid, but rather the block may be lifted so that the second lid can be applied to end face *7b* of the block. With the carton so assembled, strapping S is wrapped around the opposed tray lids 17A, 17B so as to securely bind the tray lids in tight, compressive relation with the end faces *7a, 7b* of block 3.

When the carton 1 off the present invention is so constructed and so installed on block 3 in the manner described, it will be appreciated that block 3 is rigidly and positively supported so as to maintain its desired hexahedronal shape, so as to maintain essentially flat or planar side faces *5a–5d*, so as to maintain essentially flat, planar end faces *7a* and *7b*, and so as to maintain sharp, non-rounded block edges or corners 9 to 11.

It will further be appreciated that because the overfitting tray lids 17A, 17B bear directly on the end faces *7a* and *7b* of block 3, and because wrapper 13 is formed around the side faces *5a–5d* of the cheese block, the carton 1 of the present invention will readily accomodate blocks 3 having relatively wide range of dimensional tolerances, and yet the block will be rigidly supported and maintained in its desired shape.

Still further, because the overfitting tray lids 17A and 17B bear on the end faces *7a* and *7b* of the cheese block , the carton 1 of the present invention is adapted to readily support a multiplicity of the loaded cartons stacked one on top of another because a substantial portion of the weight of each of the filled cartons 1 is supported by the block 3 within the carton rather than by the side walls and flutes (i.e., the corners) of liner 13 and of sleeve 15.

Still further, it will be appreciated that since no mechanical fasteners or glued joints are required to install the wrapper 13, the assembled sleeve 15, and the overfitting lids 17A and 17B, the carton 1 may be readily disassembled and removed from the hardened cheese block 3 without damaging the carton, and thus the carton may be reused.

While block 3 has been heretofore described as a polyhedronal-shaped block with plane sides, it will be appreciated that, within the broader aspects of this invention, the carton and method of this invention may be utilized with other shaped blocks 3, such as cylindrical blocks.

In view of the above, it will be seen that the other objects of this invention are achieved and other advantageous results obtained.

As various changes could be made in the above construcitons and methods without departing from the scope of the invention, it is intended that all matter contained in the above description or shown in the accompanying drawings shall be interpreted as illustrative and not in a limiting sense.

What is claimed is:

1. A carton containing a bulk quantity of a semi-solid block of unhardened cheese which tends to remain semi-fluid and tending to bulge during packaging, but capable of being formed into the desired block form, said block having a plurality of side faces, a pluarality of corners between said side faces, and a pair of generally parallel end faces, said carton comprising a one-piece wrapper of multi-layered sheet of corrugated boxboard material comprising at least two layers of corrugations and an outer face sheet and an inner face sheet, said wrapper being folded on itself, so as to form side panels which are in face-to-face engagement with said side faces of said block during packaging and wherein each side panel has substantially the same cross section as each side face of the block, an open-ended sleeve having a cross section similar to said block and further having a side face for each of the side panels of said wrapper and corresponding to each side face of said block, said sleeve being formed of multi-layered sheet of corrugated boxboard material, being foldable on itself so as to be in said face-to-face engagement with the side panels of said wrapper, said sleeve being telescopically received over said wrapper, with the side faces of said sleeve being in face-to-face sliding engagement with the side panels of said wrapper to securely hold the side panels of said wrapper in engagement with the side faces of said block, and with both said sleeve and said wrapper cooperatively holding said semi-solid material in its desired block form, said one-piece sheet formed wrapper being slit-scored along a plurality of lines extending perpendicularly between the top and bottom of the wrapper and with the slit-score lines constituting a slit or cut made through said outer face sheet and through one or more layers of said corrugations of said one piece wrapper such that said wrapper is folded on itself away from the slit score along said lines with the face sheet of the wrapper constituting said inner face sheet forming hinges along which the portions of said wrapper constituting said wrapper panels may be folded to relatively sharp corners as formed by said hinge between said adjacent wrapper panels, said wrapper panels being in face-to-face relation with said respective side faces of said block and said hinges receiving a respective corner of said block, the open ended sleeve formed of said sheet of corrugated boxboard material having a cross section similar to said block and having a face for each corresponding side face of said block, said sleeve being telescopically received over said wrapper with the faces of said sleeve being in tight, slidable face-to-face relation with the respective panels of said wrapper so as to positively hold said wrapper panels in tight face-to-face relation with the respective side faces of said block, said sleeve formed of a sheet of corrugated boxboard material being slit-scored along a plurality of lines so as to form corners thereof, and which corners being substantially aligned for corresponding with the formed corners of the intermediately arranged wrapper, an overfitting telescopic lid applied to each open end of such sleeve, each said lid having a planar panel in face-to-face engagement with a contiguous end face of said block, and each lid being formed of a sheet of corrugated boxboard material and foldable into the lid configuration to provide for its said application upon each open end of the combined wrapper and sleeve, and the block of unhardened cheese contained therein.

* * * * *